United States Patent [19]

Penney

[11] Patent Number: 4,500,015

[45] Date of Patent: Feb. 19, 1985

[54] CAN PUNCTURING AND EMPTYING DEVICE

[76] Inventor: William H. Penney, 8775-20th St., Lot 475, Vero Beach, Fla. 32960

[21] Appl. No.: 381,195

[22] Filed: May 24, 1982

[51] Int. Cl.[3] ..... B67B 7/24

[52] U.S. Cl. ..... 222/83.5; 222/87; 30/448

[58] Field of Search ..... 222/5, 80, 81, 83, 83.5, 222/88, 397, 173, 86, 87; 24/243 B, 278; 269/287, 288; 30/443, 444, 448

[56] References Cited

U.S. PATENT DOCUMENTS

| | | | |
|---|---|---|---|
| 1,199,052 | 9/1916 | Crawford | 24/243.5 |
| 1,412,187 | 4/1922 | Lopdell | 24/278 |
| 2,033,151 | 3/1936 | Ramsey | 222/86 |
| 2,622,767 | 12/1952 | Kovalik et al. | 222/83.5 |
| 3,147,887 | 9/1964 | Brooks | 222/83.5 |
| 4,023,761 | 5/1977 | Molis | 24/278 X |

FOREIGN PATENT DOCUMENTS

| | | | |
|---|---|---|---|
| 323173 | 12/1934 | Italy | 222/86 |

*Primary Examiner*—Joseph J. Rolla
*Assistant Examiner*—Frederick R. Handren
*Attorney, Agent, or Firm*—Robert D. Farkas

[57] ABSTRACT

A can puncturing and emptying device utilizes a frame in which a can, including cans whose contents are under gaseous pressure, may be received. A threaded shaft carries a plate which may be adjusted to clampingly engage the periphery of the can, securing the frame about a portion of the can. Another threaded rod, having a sharpened point, may be advanced towards and into the interior of the can, piercing the can at a preferred location. A foam-like plastic material, carried by the frame, minimizes uncontrolled forceful ejection of the contents of the can, thereby rendering the can safe for disposal.

11 Claims, 3 Drawing Figures

CAN PUNCTURING AND EMPTYING DEVICE

BACKGROUND OF THE INVENTION

1. The Field of the Invention

The present invention relates to container openers, and more particularly, to a container opener adapted for use with cans containing materials under pressure, such as aerosols.

2. Description of the Prior Art

The prior art abounds with can opening devices, adapted for use on metallic cans, inclusive of lid removal types and, a class of devices which expose the interior of metallic or rigid cans by punching or forming holes in such cans. In the latter class, U.S. Pat. No. 2,584,047, issued Jan. 29, 1952 to J. F. Phillips teaches a frame-like mechanism, bent so as to provide a guideway for a shaft. One end of the shaft is equipped with a sharpened conical point. The other end of the shaft is provided having a "mushroom" shaped cap affixed thereto. A spring urges the shaft upwardly, and away from the can, when the frame is rested and secured to the sides and uppermost lid-portion of the can. By exerting a rapid downward force, the sharpened tip of the shaft pierces the lid of the can and provides an opening therein, from which the gas and/or liquid contents in the interior of the can may be removed or exposed to the atmosphere. The Phillips apparatus is not suitable for pressurized cans, since the contents of such cans would instantaneously, and with great freedom, exit the interior of the can through the opening formed by the conical tip when piercing the lid portion of the can.

U.S. Pat. No. 2,376,756, issued on May 22, 1945 to P. C. Bye discloses a cup-like structure having an open mouth portion. Emergible, outwardly from the open mouth portion, in its various embodiments, Bye teaches one or more conically shaped pointed elements, which, when directed towards and through the open mouth portion of the structure can pierce one or more locations on the lid of a can. Though the force applied by the Bye conical points, in the case of two or more points, or in the case of a single point, provides a symmetrical piercing force to the lid of a can, the contents of such can will rapidly and suddenly be evacuated if such contents are under pressure.

The present invention overcomes a rapid and sudden evacuation or emergence of a can having pressurized contents. This is accomplished by piercing the side of a pressurized can in a controlled manner, so as to control the size of the opening, the rate of speed in which such opening is formed, and the rate of speed at which the apparatus forming such opening is withdrawn therefrom. Further, the present invention restricts the flow of materials, exiting an otherwise unobstructed opening, so as to prevent a user from becoming sprayed with the content of the can. The opening formed by the present invention, may be positioned anywhere along the length of the side a can, thereby minimizing the accidental discharge of liquid, under pressure, by positioning the opening above the level of the liquid. Such liquid can be poured, if desired, outwardly through the opening, for retrieval or disposal purposes. The cans employed in the present invention are not subjected to sudden shock or jarring, when they are opened.

SUMMARY OF THE INVENTION

A primary object of the present invention is to provide a can puncturing and emptying device which punctures an opening in the side of a can to a controlled size.

Another object of the present invention is to provide a can puncturing device which permits the pressurized contents of a can to emerge at a controlled speed, at the will of the user.

Still another object of the present invention is to provide an apparatus which positions an opening at preferred locations along the length of the side of a cylindrical or rectangular container.

Yet another object of the present invention is to provide a can opening device in which the contents of the can are absorbed and deflected by a cushion, clamped surrounding the opening, thereby preventing accidental soiling of the hands and body of the user.

A further object of the present invention is to provide a can puncturing device which permits the pressurized can to be punctured without subjecting the can to sudden shock or vibration implementing a safe and sanitary discharge of gaseous and liquid content of the can.

These objects as well as further objects and advantages of the present invention will become readily apparent after reading the description of a non-limiting illustrative embodiment and the accompanying drawing.

The present invention provides a frame. The frame is adapted to encircle the boundaries of the can, intermediate the base and uppermost regions thereof. The frame includes a clamping mechanism, such that the frame may be lockingly removeably engaged to the can at a preferred location. A threaded shaft is provided, which shaft is threadingly engaged to the frame having its longitudinal axis extending transverse to the longitudinal axis of the can. The free end of the threaded shaft is provided having an elongated tapered point, the apex of which is positioned closest to the periphery of the can. Upon rotation of the threaded shaft, its free point is directed towards and into the can, puncturing same in a controlled manner. Upon rotating the threaded shaft in an opposite direction, the opening formed by the point to end of the shaft is exposed, allowing the gaseous content of the can to escape. A foam-like material is positioned intermediate the interior of the frame and the exterior of the can, surrounding the location at which the pointed end of the threaded shaft pierces the can. Such foam-like material deflects and absorbs the content of the can which emerges forcibly from the opening, partly or fully exposed upon the removal of the pointed end of the threaded shaft therefrom.

BRIEF DESCRIPTION OF THE DRAWINGS

In order that the present invention may be fully understood it will now be described, by way of example, with reference to the accompanying drawings in which.

DESCRIPTION OF THE PREFERRED EMBODIMENT

Figure 1:
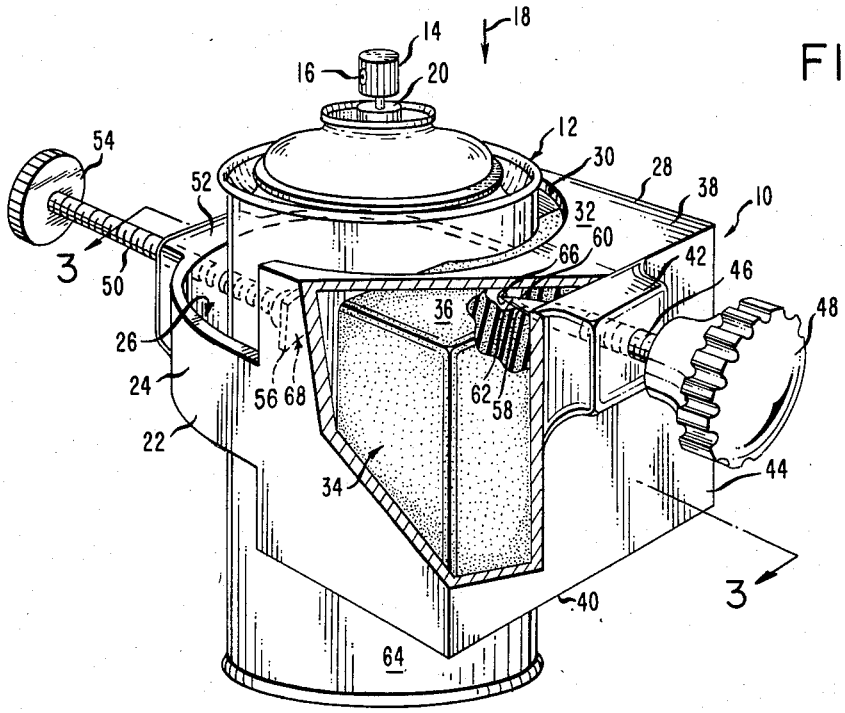
FIG. 1 illustrates a perspective view of the present invention shown engaged about a cylindrical can.

Referring now to the figures, and more particularly to FIG. 1, there is illustrated therein the present invention 10, shown engaged with a conventional, well known pressurized cylindrical can 12. It should be understood that the present invention may be utilized with conventional cans, as well as with pressurized cans. Can 12 is shown provided having knob 14 equipped with opening 16. As is well known, upon depressing knob 14 in the direction of arrow 18, by manual manipulation, the content of the interior of can 12 is propelled outwardly from opening 16, due to the gaseous pressure contained within can 12. Paint sprays, paint, cleaning fluids, and a wide variety of other liquids are propelled outwardly from opening 16, due to the mixture of gases and liquids, forming an atomized spray when valve 20, forming part of can 12, is opened due to the manipulation of knob 14. Frame 22 is shown having a girth encircling band 24. As shown, girth encircling band 24 is adapted to reside about cans equal or greater in size than can 12. However, if desired, band 24 may be triangular in shape, or rectangular in shape, so as to permit the insertion of cans having any desired cross section or size within the opening 26, formed by band 24. Frame portion 28 is provided having uppermost semicircular marginal edge 30, likewise adapted to receive cans of a wide variety of circular sizes. If desired, marginal edge portion 30 may be fabricated so as to be rectangular in shape, thereby permitting the introduction of a rectangular can in between marginal edge 30 and the interior surface of band 24. Frame portion 28 has uppermost surface 32 thereof and the lowermost surface, not shown, configured to receive foam-like pad 34 therein between. Pad 34 comprises a cellular plastic foam material, such as polyurethane, of open or closed cell configuration, whose uppermost surface 36 resides between plates 38 and 40. Plates 38 and 40 include marginal edge 30 and another marginal edge, not shown, similar to marginal edge 30. Boss 42 is attached to plate 44, which forms a part of frame portion 28. Threaded shaft 46 is threadingly engaged in boss 42, having one end thereof terminating in hand grasping knob 48. Threaded shaft 50 is threadingly engaged to boss 52 and is provided with knob 54 at a free end. The other free end of threaded shaft 50 is equipped with plate-like foot 56, shown in dotted lines. End 58 of threaded shaft 46 is shown having an elongated conical point-like shape. Apex 60, of pointed end 62 is shown engaging the exterior surface 64 of can 12 at point 66. Plate 44, band 24, plates 38 and 40, bosses 42 and 52 make comprise a unitary construction, fabricated from metallic material, such as steel or—if desired—may be fabricated from a plastic material, such a phenol compound, to provide an inexpensive, lightweight, yet durable article of manufacture. Threaded screws 46 and 50 are preferably fabricated from a metallic material, such as steel, whilst knob 54 and 48 may be fabricated from any convenient material, such as durable plastic. Foot 56 may be similarly fabricated from a plastic or metallic material. Can contacting surface 68 of foot-like plate 56, may be flat or may be concave, if desired.

Figure 2:
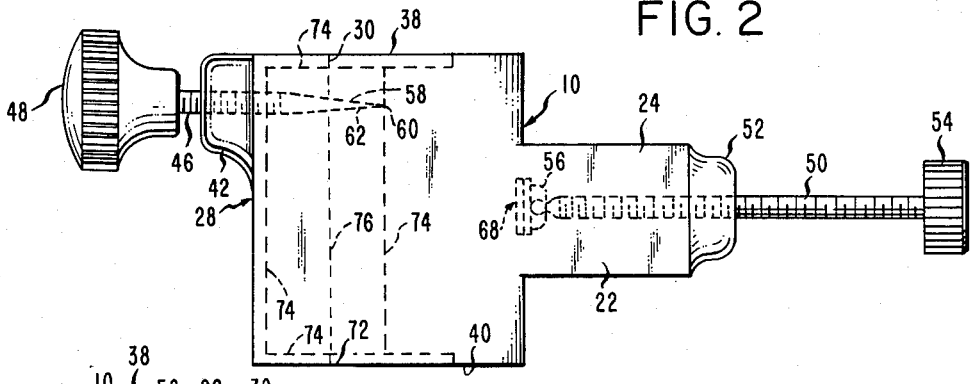
FIG. 2 is a side elevation view of the embodiment of the present invention illustrated in FIG. 1.

FIG. 2 illustrates cutaway portion 72 of lowermost plate 40, adapted to engage the side of can 12, shown in FIG. 1, such that the longitudinal axis of can 12 extends substantially parallel to the left most regions of cutaway portions 30 and 72, as shown in FIG. 2. Dotted lines 74 depict the location of pad 34. A can, not shown, having a maximum side-to-side dimension not exceeding the spacing between surface 68 of foot-like plate 56 and dotted line 76 may be inserted within frame 22. Upon the rotation of knob 54, in a given direction, foot 56 advances towards frame portion 28, clampingly engaging a can, not shown, to frame 22. Upon rotating knob 48, pointed or apex end 60 of elongated conically shaped end 62, is directed towards the surface of a can, not shown.

Figure 3:
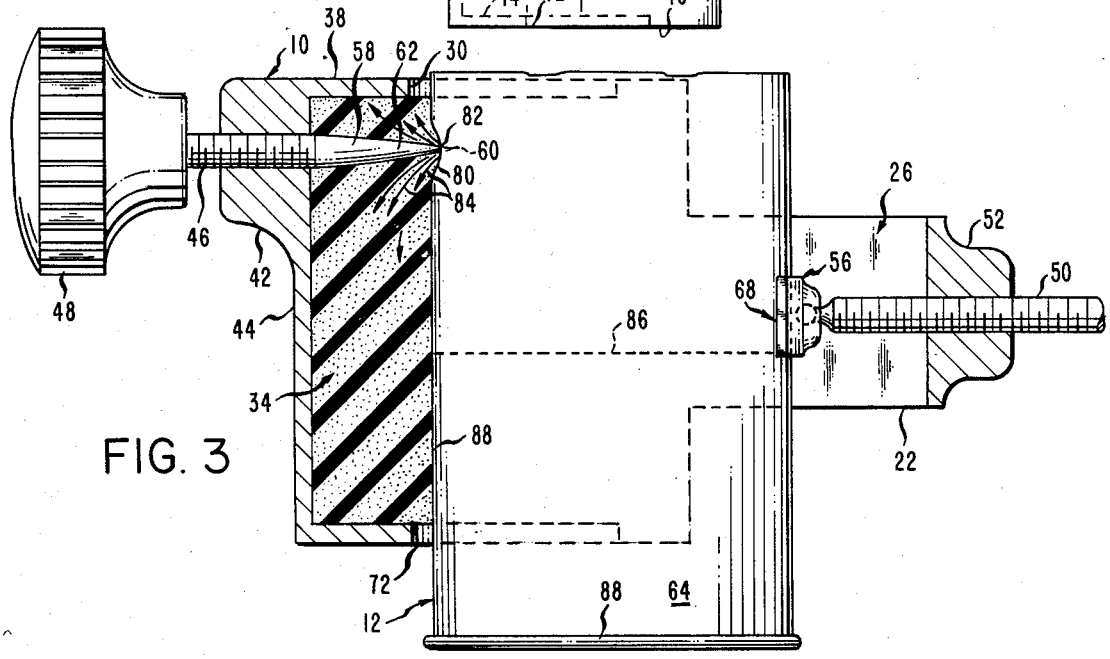
FIG. 3 is a partial cross sectional view of the apparatus shown in FIG. 1, taken through lines 3—3, viewed in the direction of arrows 3—3.

FIG. 3 shows depressed region 80, comprising a portion of the exterior surface 64 of can 12. Within region 80, opening 82 has been formed by the insertion of taper 62 such that apex end 60, pierces the interior of can 12. Arrows 84 depict the direction taken by any gaseous discharge, emerging outwardly from opening 82, only to be absorbed or at least deflected and controlled by pad 34. Dotted lines 86 symbolizes a liquid content disposed within the interior of can 12, located beneath apex 60, and above base 88 of can 12. When apparatus 10 is positioned as shown, virtually only gaseous effluent will emerge outwardly from opening 82. If it is desired to position opening 82 near base 88, located below the level of liquid depicted by dotted lines 86, then, gaseous as well as the liquid content of can 12 will emerge outwardly from such opening.

Upon the conclusion of use, a pierced can, having an opening disposed above the level of liquids, may be emptied after retracting foot-like plate 56 and tapered point 62 from engagement with can 12. Can 12 may then be withdrawn, in the upright position, from apparatus 10, so as to permit—if desired—the liquid content, no longer under pressure, to be emptied from the now safe incinerable can.

It should be specifically understood that non-pressurized cans, whose lids, tops, or other closures may not be safely or easily opened, may be manipulated by the present invention so as to have content of such cans disposed of prior to the entire can being discarded.

It will be understood that various changes in details, materials, arrangements of parts, and operation conditions which have herein been described and illustrated in order to explain the nature of the invention may be made by those skilled in the art within the principles and scope of the invention.

One of the advantages of the present invention is a can puncturing and emptying device which punctures an opening in the side of a can to a controlled size.

Another advantage of the present invention is a can puncturing device which permits the pressurized contents of a can to emerge at a controlled speed, at the will of the user.

Still another advantage of the present invention is an apparatus which positions an opening at preferred locations along the length of the side of a cylindrical or rectangular container.

Yet another advantage of the present invention is a can opening device in which the contents of the can are absorbed and deflected by a cushion, clamped surrounding the opening, thereby preventing accidental soiling of the hands and body of the user.

A further advantage of the present invention is a can puncturing device which permits the pressurized can to be punctured without subjecting the can to sudden shock or vibration implementing a safe and sanitary discharge of gaseous and liquid content of the can.

Thus, there is disclosed in the above description and in the drawings, an embodiment of the invention which fully and effectively accomplishes the objects thereof. However, it will become apparent to those skilled in the art, how to make variations and modifications to the instant invention. Therefore, this invention is to be limited, not by the specific disclosure herein, but only by the appending claims.

The embodiment of the invention in which an exclusive privilege or property is claimed are defined as follows:

1. A can puncturing and emptying device comprising a frame, said frame including a band portion, said band portion having an opening configured to permit portions of a can to pass therethrough, said can having an exterior surface, means to clampingly engage said can to said frame, a threaded shaft, said threaded shaft threadingly engaged to said frame, one end of said threaded shaft having an elongated point-like shape, said threaded shaft having a longitudinal axis, said longitudinal axis of said threaded shaft being disposed at right angles to the surface of said can, means to advance and retract said end of said threaded shaft towards and away from a portion of said exterior surface of said can inwardly and outwardly from said opening, a mat, said mat comprising a cellular material for diffusing fluid issuing from a hole punctured in the can by the point-like end of the threaded shaft, said mat being compressed between said portion of said exterior surface of said can and said frame, a portion of said mat disposed surrounding said pointed end of said threaded shaft, whereby rotating said threaded shaft in a first direction engages said pointed end thereof with said portion of said exterior surface of said can and upon continued rotation pierces said portion of said exterior surface of said can forming a hole therein and whereby counter rotation of said threaded shaft positions said pointed end of said threaded shaft outwardly from said portion of said exterior surface of said can to permit the fluid contents of the can to discharge through the hole and be diffused through said mat, said pointed end of said shaft being movable towards an exterior surface of said mat that is engaged with said portion of said can upon said threaded shaft being rotated in a first direction and being positioned passing through said exterior surfaces of said can and said mat upon said continued rotation of said threaded shaft a distance limited only by the amount of rotation of said threaded shaft in said first direction, whereby said hole in said can is positioned adjacent said exterior surface of said mat.

2. The apparatus as claimed in claim 1 wherein said means to clampingly engage comprises another threaded shaft, said another threaded shaft being threadingly engaged to said band portion, one end of said other threaded shaft carrying a knob, a foot-like plate, said foot-like plate rotatably secured to the other end of said other shaft.

3. The apparatus as claimed in claim 2 wherein said foot-like plate has a convave surface.

4. The apparatus as claimed in claim 1 wherein the opening in said band is of circular cross section.

5. The apparatus as claimed in claim 1 wherein said mat comprises open cell polyurethane plastic.

6. The apparatus as claimed in claim 1 wherein said threaded shaft is disposed having its longitudinal axis extending transverse to said opening of said band.

7. The apparatus as claimed in claim 3 wherein the longitudinal axis of said shaft and the longitudinal axis of said other shaft are disposed parallel to each other and out of co-axial alignment with one another.

8. The apparatus as claimed in claim 1 wherein said mat is removeably engaged within said frame.

9. The apparatus as claimed in claim 1 wherein said frame is a unitary structure.

10. The apparatus as claimed in claim 1 wherein said point comprises an elongated cone.

11. The apparatus as claimed in claim 1 wherein said threaded shaft comprises a solid metallic material.

* * * * *